US010771896B2

(12) United States Patent
Bharitkar

(10) Patent No.: US 10,771,896 B2
(45) Date of Patent: Sep. 8, 2020

(54) CROSSTALK CANCELLATION FOR SPEAKER-BASED SPATIAL RENDERING

(71) Applicant: Hewlett-Packard Development Company, L.P., Spring, TX (US)

(72) Inventor: Sunil Bharitkar, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/471,893

(22) PCT Filed: Apr. 14, 2017

(86) PCT No.: PCT/US2017/027718
§ 371 (c)(1),
(2) Date: Jun. 20, 2019

(87) PCT Pub. No.: WO2018/190875
PCT Pub. Date: Oct. 18, 2018

(65) Prior Publication Data

US 2020/0029155 A1 Jan. 23, 2020

(51) Int. Cl.

| | |
|---|---|
| ***H04S 7/00*** | (2006.01) |
| ***H04R 3/00*** | (2006.01) |
| ***H04R 3/14*** | (2006.01) |

(52) U.S. Cl.
CPC ..... *H04R 3/14* (2013.01); *H04S 7/303* (2013.01); *H04S 2420/01* (2013.01)

(58) Field of Classification Search
CPC ... H04S 7/00; H04S 7/30; H04S 7/302; H04S 7/303; H04S 7/305; H04S 3/00; H04S 3/02; H04S 1/00; H04S 1/01; H04S 2420/01; H04S 2400/01; H04S 5/00; H04R 3/00;
(Continued)

(56) References Cited

U.S. PATENT DOCUMENTS 5,333,200 A * 7/1994 Cooper ..... H04S 1/002 381/1
6,577,736 B1 6/2003 Clemow
(Continued)

FOREIGN PATENT DOCUMENTS

WO WO-9842162 A2 9/1998

OTHER PUBLICATIONS

Baia, M. et al., Comparative Study of Audio Spatializers for Dual-loudspeaker Mobile Phones, Jan. 2007,< http://asa.scitation.org/doi/10.1121/1.2387121 >.

*Primary Examiner* — Thang V Tran
(74) *Attorney, Agent, or Firm* — Mannava & Kang

(57) ABSTRACT

In some examples, crosstalk cancellation for speaker-based spatial rendering may include perceptually smoothing head-related transfer functions (HRTFs) corresponding to ipsilateral and contralateral transfer paths of sound emitted from first and second speakers to corresponding first and second destinations. The crosstalk cancellation may further include inserting an inter-aural time difference in the perceptually smoothed HRTFs corresponding to the contralateral transfer paths. A crosstalk canceller may be generated by inverting the perceptually smoothed HRTFs corresponding to the ipsilateral transfer paths and the perceptually smoothed HRTFs corresponding to the contralateral transfer paths including the inserted inter-aural time difference.

15 Claims, 12 Drawing Sheets

(58) Field of Classification Search
CPC ... H04R 3/12; H04R 3/14; H04R 5/00; H04R 5/02; H04R 5/04; G10L 19/008
See application file for complete search history.

(56) References Cited

U.S. PATENT DOCUMENTS

| | | | | |
|---|---|---|---|---|
| 6,683,959 | B1 * | 1/2004 | Kuwano | H03H 17/04 381/1 |
| 7,197,151 | B1 * | 3/2007 | Sibbald | H04S 1/002 381/17 |
| 7,536,017 | B2 | 5/2009 | Sakurai et al. | |
| 8,320,592 | B2 * | 11/2012 | Kim | H04S 1/00 381/17 |
| 8,619,998 | B2 * | 12/2013 | Walsh | H04S 3/02 381/17 |
| 9,167,344 | B2 | 10/2015 | Choueiri | |
| 2001/0012367 | A1 * | 8/2001 | Sotome | H04S 3/00 381/1 |
| 2002/0038158 | A1 * | 3/2002 | Hashimoto | H04S 1/002 700/94 |
| 2006/0083394 | A1 * | 4/2006 | McGrath | H04S 3/00 381/309 |
| 2007/0110249 | A1 * | 5/2007 | Kimura | H04S 1/002 381/17 |
| 2007/0223750 | A1 * | 9/2007 | Bai | H04S 1/002 381/309 |
| 2008/0273721 | A1 * | 11/2008 | Walsh | H04S 5/00 381/300 |
| 2009/0046864 | A1 | 2/2009 | Mahabub et al. | |
| 2015/0245157 | A1 | 8/2015 | Seefeldt | |
| 2017/0257725 | A1 * | 9/2017 | Sapozhnykov | H04S 7/305 |
| 2018/0152787 | A1 * | 5/2018 | Son | H04S 1/002 |

* cited by examiner

CROSSTALK CANCELLATION FOR SPEAKER-BASED SPATIAL RENDERING

BACKGROUND

Devices such as notebooks, desktop computers, mobile telephones, tablets, and other such devices may include speakers or utilize headphones to reproduce sound. The sound emitted from such devices may be subject to a variety of processes that modify the sound quality.

BRIEF DESCRIPTION OF DRAWINGS

Features of the present disclosure are illustrated by way of example and not limited in the following figure(s), in which like numerals indicate like elements, in which.

DETAILED DESCRIPTION

Figure 1:
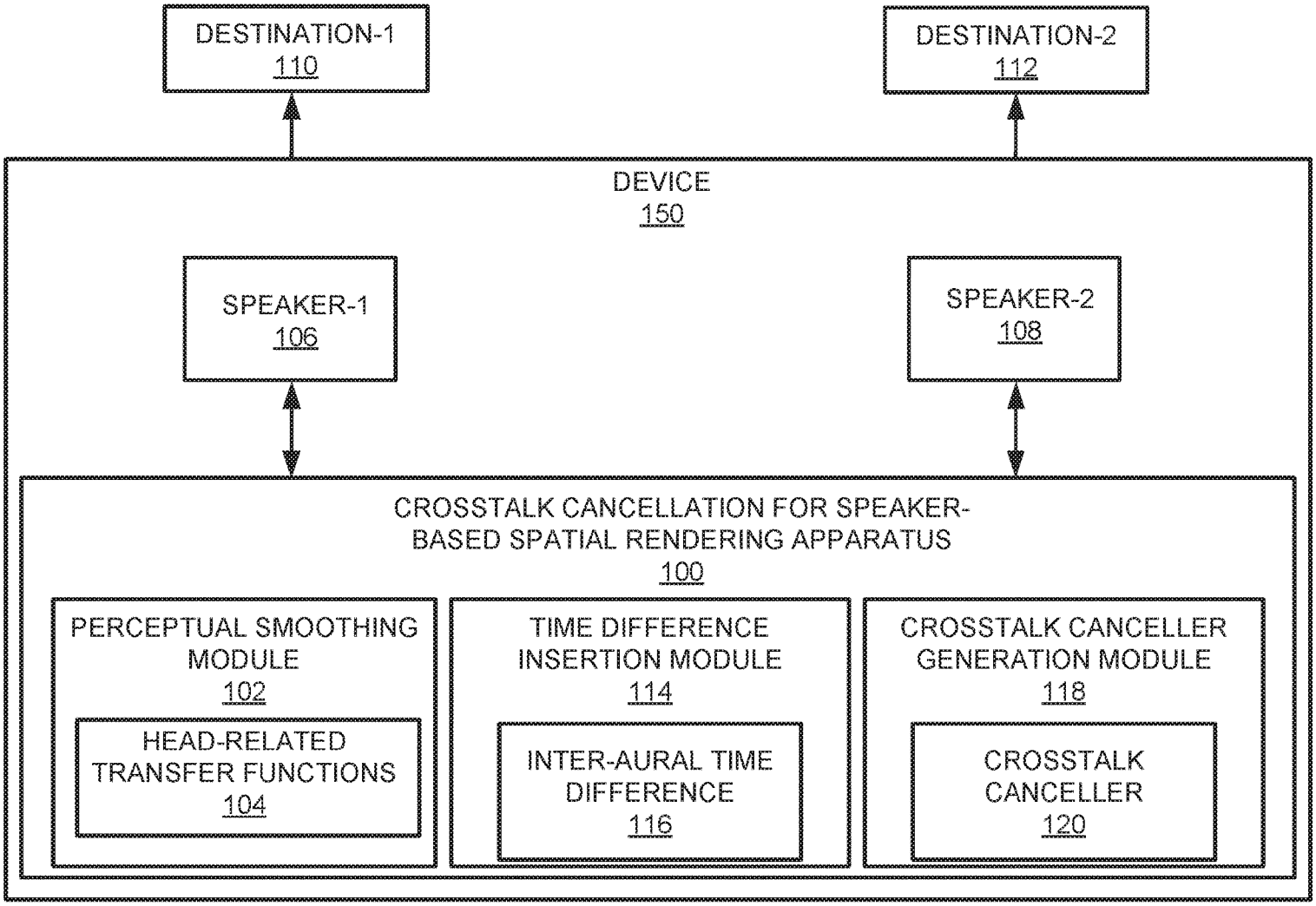
FIG. 1 illustrates an example layout of a crosstalk cancellation for speaker-based spatial rendering apparatus.

For simplicity and illustrative purposes, the present disclosure is described by referring mainly to examples. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure.

Throughout the present disclosure, the terms "a" and "an" are intended to denote at least one of a particular element. As used herein, the term "includes" means includes but not limited to, the term "including" means including but not limited to. The term "based on" means based at least in part on.

Crosstalk cancellation for speaker-based spatial rendering apparatuses, methods for crosstalk cancellation for speaker-based spatial rendering, and non-transitory computer readable media having stored thereon machine readable instructions to provide crosstalk cancellation for speaker-based spatial rendering are disclosed herein. The apparatuses, methods, and non-transitory computer readable media disclosed herein provide for crosstalk cancellation based on perceptual smoothing of head-related transfer functions (HRTFs), insertion of an inter-aural time difference, and time-domain inversion of a regularized matrix determined from the perceptually smoothed HRTFs.

With respect to crosstalk cancellation, devices such as notebooks, desktop computers, mobile telephones, tablets, and other such devices may include speakers or utilize headphones to reproduce sound. Such devices may utilize a high-quality audio reproduction to create an immersive experience for cinematic and music content. The cinematic content may be multichannel (e.g., 5.1, 7.1, etc., where 5.1 represents "five point one" and includes a six channel surround sound audio system, 7.1 represents "seven point one" and includes an eight channel surround sound audio system, etc.). Elements that contribute towards a high-quality audio experience may include the frequency response (e.g., bass extension) of the speakers or drivers, and proper equalization to attain a desired spectral balance. Other elements that contribute towards a high-quality audio experience may include artifact-free loudness processing to accentuate masked signals and improve loudness, and spatial quality that reflects artistic intent for stereo music and multichannel cinematic content.

With respect to spatial rendering with speakers, crosstalk cancellation may provide for the reproduction of virtual sound sources at a listener's ears by inverting acoustic transfer paths. A crosstalk canceller (e.g., a crosstalk cancellation filter) may be updated in real time according to the head position of a listener, as the angles of the speakers relative to a center of listener's head change with lateral head movements. Crosstalk cancellers may present technical challenges with respect to the introduction of artifacts in a rendering over the speakers. These artifacts may include frequency-domain-based artifacts (e.g., over-excursion of the speakers in the low and high-frequencies, artifacts in the voice-region, etc.), as well as temporal artifacts (e.g., metallic and reverberant sound processing).

In order to address at least these technical challenges associated with the introduction of artifacts, the apparatuses, methods, and non-transitory computer readable media disclosed herein provide for crosstalk cancellation that provides for a sense of relatively strong immersion with respect to sound and imperceptible artifacts. In this regard, the apparatuses, methods, and non-transitory computer readable media disclosed herein provide for crosstalk cancellation based on perceptual smoothing of the HRTFs, insertion of an inter-aural time difference, as well as constrained inversion of a cancellation matrix for crosstalk cancellation. An HRTF may be described as a response that characterizes how an ear receives a sound from a point in space.

For the apparatuses, methods, and non-transitory computer readable media disclosed herein, the perceptual smoothing provides for reduction of the effect of a "sweet-spot" caused by lateral head-movements of a listener. In this regard, the sweet-spot may represent a focal point between two speakers where a listener is fully capable of hearing a stereo audio mix the way the audio mix is intended to be heard. The perceptual smoothing also provides for the design of reduced filter orders, for example, by eliminating high-frequency noise and variations in the HRTFs that are not perceptually relevant for spatial reproduction.

For the apparatuses, methods, and non-transitory computer readable media disclosed herein, a constrained inversion of the perceptually smoothed HRTFs may be performed through the use of regularization, and validation of a condition number of a regularized matrix before inversion. In this regard, as disclosed herein, a tradeoff may be achieved, for example, by analyzing the condition number with respect to an objective cancellation performance, a subjective audio quality, and robustness to head-movements.

For the apparatuses, methods, and non-transitory computer readable media disclosed herein, modules, as described herein, may be any combination of hardware and programming to implement the functionalities of the respective modules. In some examples described herein, the combinations of hardware and programming may be implemented in a number of different ways. For example, the programming for the modules may be processor executable instructions stored on a non-transitory machine-readable storage medium and the hardware for the modules may include a processing resource to execute those instructions. In these examples, a computing device implementing such modules may include the machine-readable storage medium storing the instructions and the processing resource to execute the instructions, or the machine-readable storage medium may be separately stored and accessible by the computing device and the processing resource. In some examples, some modules may be implemented in circuitry.

FIG. 1 illustrates an example layout of a crosstalk cancellation for speaker-based spatial rendering apparatus (hereinafter also referred to as "apparatus 100").

In some examples, the apparatus 100 may include or be provided as a component of a device such as a notebook, a desktop computer, a mobile telephone, a tablet, and other such devices. For the example of FIG. 1, the apparatus 100 is illustrated as being provided as a component of a device 150, which may include a notebook, a desktop computer, a mobile telephone, a tablet, and other such devices. In some examples, a crosstalk canceller generated by the apparatus 100 as disclosed herein may be provided as a component of the device 150 (e.g., see FIG. 2), without other components of the apparatus 100.

Referring to FIG. 1, the apparatus 100 may include a perceptual smoothing module 102 to perceptually smooth head-related transfer functions (HRTFs) 104 corresponding to ipsilateral and contralateral transfer paths of sound emitted from first and second speakers 106 and 108, respectively, to corresponding first and second destinations, 110 and 112. According to an example, the perceptual smoothing may include phase and magnitude smoothing, or complex smoothing of the HRTFs 104. According to an example, the first and second destinations 110 and 112 may respectively correspond to first and second ears of a user.

A time difference insertion module 114 is to insert an inter-aural time difference 116 (also designated ITD) in the perceptually smoothed HRTFs corresponding to the contralateral transfer paths. According to an example, the inter-aural time difference may be determined as a function of a head radius of the user, and an angle of one of the speakers (e.g., the speaker 106 or 108) from a median plane of a device (e.g., the device 150) that includes the speakers.

A crosstalk canceller generation module 118 is to generate a crosstalk canceller 120 by inverting the perceptually smoothed HRTFs corresponding to the ipsilateral transfer paths and the perceptually smoothed HRTFs corresponding to the contralateral transfer paths including the inserted inter-aural time difference 116. As disclosed herein, in some examples, the crosstalk canceller 120 may be provided as a component of the device 150 (e.g., see also FIG. 2), without other components of the apparatus 100. Application of the crosstalk canceller 120 to signals received by the first and second speakers 106 and 108, respectively, may provide for attenuation of a contralateral response of the first and second speakers 106 and 108.

According to an example and as disclosed herein, the crosstalk canceller generation module 118 is to generate the crosstalk canceller 120 by performing a time-domain inversion of a regularized matrix determined from the perceptually smoothed HRTFs corresponding to the ipsilateral transfer paths and the perceptually smoothed HRTFs corresponding to the contralateral transfer paths including the inserted inter-aural time difference 116. In this regard, as disclosed herein, the crosstalk canceller generation module 118 is to determine a time-domain matrix from the perceptually smoothed HRTFs corresponding to the ipsilateral transfer paths and the perceptually smoothed HRTFs corresponding to the contralateral transfer paths including the inserted inter-aural time difference 116, determine a regularization term (e.g., $\beta$) to control inversion of the time-domain matrix, and invert the time-domain matrix based on the regularization term to generate the regularized matrix. Further, as disclosed herein, the crosstalk canceller generation module 118 is to determine the regularization term to control the inversion of the time-domain matrix by comparing a condition number associated with a transpose of the time-domain matrix to a threshold (e.g., 100), and in response to a determination that the condition number is below the threshold, invert the time-domain matrix based on the regularization term to generate the regularized matrix. Thus, the crosstalk canceller generation module 118 is to validate the condition number of the regularized matrix prior to the performing of the time-domain inversion of the regularized matrix.

Figure 2:
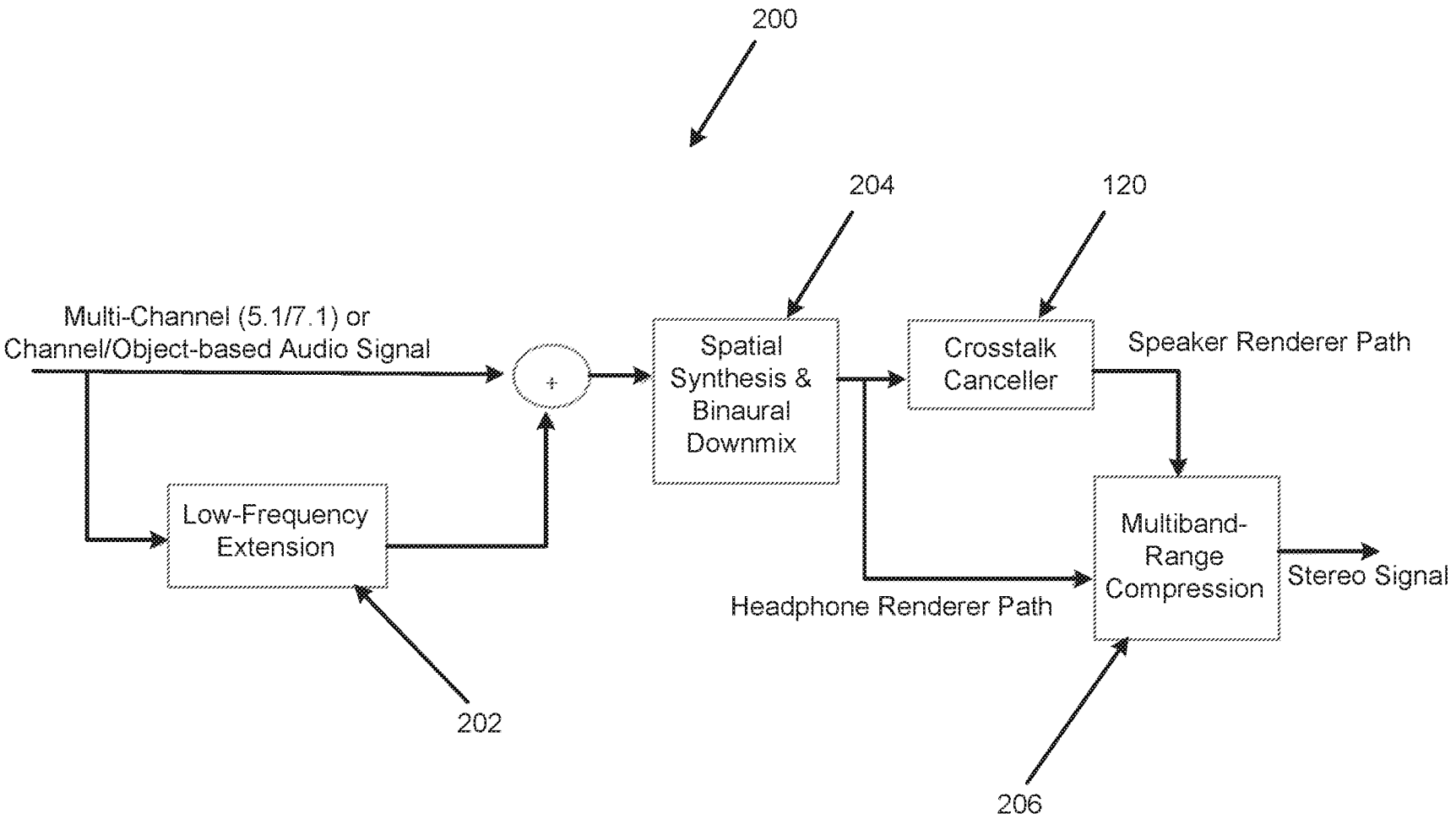
FIG. 2 illustrates an example layout of an immersive audio renderer.

FIG. 2 illustrates an example layout of an immersive audio renderer 200.

Referring to FIG. 2, the apparatus 100 may be implemented in the immersive audio renderer 200 of FIG. 2. For the example of FIG. 2, the crosstalk canceller 120 (without other components of the apparatus 100) is illustrated as being implemented in the immersive audio renderer 200. The immersive audio renderer 200 may be integrated in consumer, commercial, and mobility devices, in the context of multichannel content (e.g., cinematic content). For example, the immersive audio renderer 200 may be integrated in a device such as a notebook, a desktop computer, a mobile telephone, a tablet, and other such devices.

The immersive audio renderer 200 may be extended to accommodate next-generation audio formats (including channel/objects or pure object-based signals and metadata) as input to the immersive audio renderer 200. In addition to the crosstalk canceller 120, the immersive audio renderer 200 may include a low-frequency extension 202 that performs a synthesis of non-linear terms of the low pass audio signal in the side chain. Specifically auditory motivated filterbanks filter the audio signal, the peak of the signal may be tracked in each filterbank, and the maximum peak over all peaks or each of the peaks may be selected for nonlinear term generation. The nonlinear terms for each filterbank output may then be band pass filtered and summed into each of the channels to create the perception of low frequencies. The immersive audio renderer 200 may include spatial synthesis and binaural downmix 204 where reflections and desired direction sounds may be mixed in prior to crosstalk cancellation. For example, the spatial synthesis and binaural downmix 204 may apply HRTFs to render virtual sources at desired angles (and distances). According to an example, the perceptually-smoothed HRTFS may be for angles ±40° for the front left and front right sources (channels), 0° for the center, and ±110° degrees for the left and right surround sources (channels). The immersive audio renderer 200 may include multiband-range compression 206 that performs multiband compression, for example, by using perfect reconstruction (PR) filterbanks, an International Telecommunication Union (ITU) loudness model, and a neural network to generalize to arbitrary multiband dynamic range compression (DRC) parameter settings.

Figure 3:
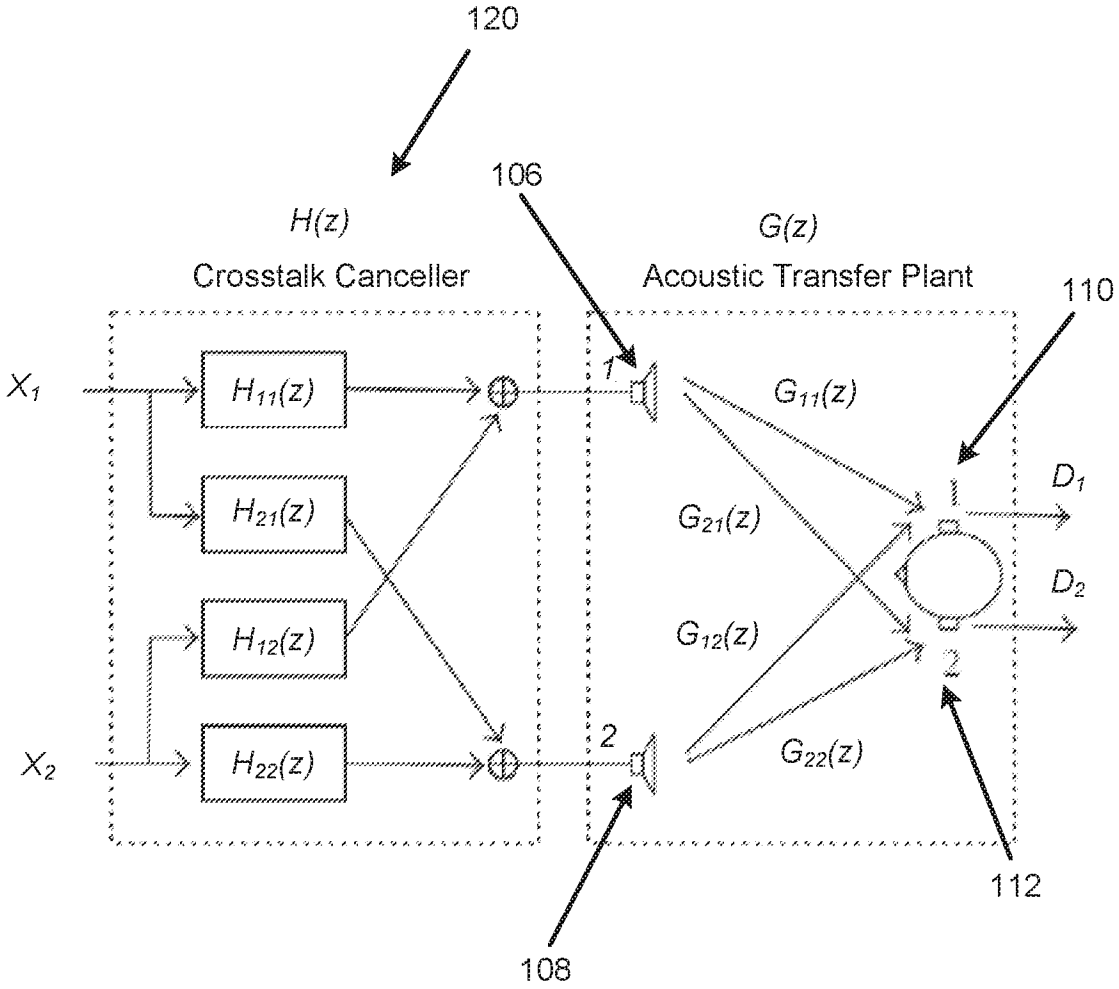
FIG. 3 illustrates an example layout of a crosstalk-canceller and a binaural acoustic transfer function.

FIG. 3 illustrates an example layout of the crosstalk-canceller 120 and a binaural acoustic transfer function.

Referring to FIG. 3, for the crosstalk-canceller 120, the acoustic path ipsilateral responses $G_{11}(z)$ and $G_{22}(z)$ (e.g., same-side speaker as the ear) and contralateral responses $G_{12}(z)$ and $G_{21}(z)$ (e.g., opposite-side speaker as the ear) may be determined based on the distance and angle of the ears to the speakers. For example, FIG. 3 illustrates speakers 106 and 108, respectively also denoted speaker-1 and speaker-2 in FIG. 1. Further, a user's ears corresponding to the destinations 110 and 112 (e.g., see FIG. 1) may be respectively denoted as ear-1 and ear-2. In this regard $G_{11}(z)$ may represent the transfer function from speaker-1 to ear-1, $G_{22}(z)$ may represent the transfer function from speaker-2 to ear-2, and $G_{12}(z)$ and $G_{21}(z)$ may represent the crosstalks. The crosstalk canceller 120 may be denoted by the matrix H(z), which may be designed to send a signal $X_1$ to ear-1, and a signal $X_2$ to ear-2. For the example of FIG. 3, the angle of the ears to the speakers 106 and 108 may be specified as 15° relative to a median plane, where devices such as notebooks, desktop computers, mobile telephones, etc., may include speakers towards the end or edges of a screen.

For the example layout of the crosstalk-canceller and the binaural acoustic transfer function of FIG. 3, the acoustic responses (viz., the $G_{11}(z)$ for the source angles) may include the HRTFs corresponding to ipsilateral and contralateral transfer paths. The HRTFs may be obtained from an HRTF database, such as an HRTF database from the Institute for Research and Coordination in Acoustics/Music (IRCAM).

Figure 4:
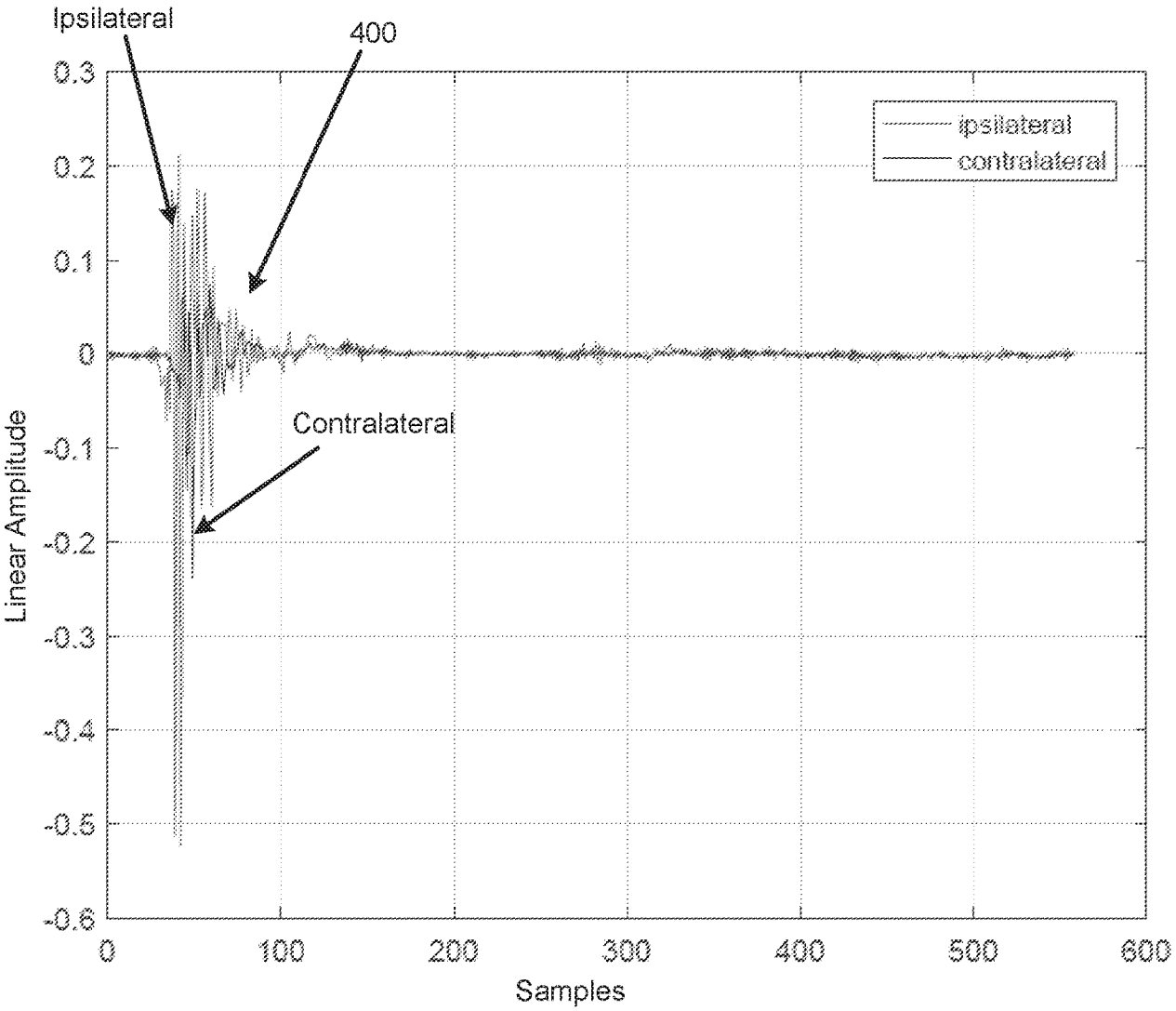
FIG. 4 illustrates an example time-domain response of ipsilateral and contralateral head-related transfer functions (HRTFs)

FIG. 4 illustrates an example time-domain response of ipsilateral and contralateral HRTFs. Further, FIG. 5 illustrates an example magnitude response of the time-domain response of ipsilateral and contralateral HRTFs of FIG. 4.

Referring to FIG. 4, since the time-domain response of ipsilateral and contralateral HRTFs for $G_{11}(z)$ and $G_{21}(z)$ are assumed to be identical to the time-domain response of ipsilateral and contralateral HRTFs for $G_{22}(z)$ and $G_{12}(z)$, FIG. 4 illustrates an example time-domain response of ipsilateral and contralateral HRTFs for $G_{11}(z)$ and $G_{21}(z)$ (and similarly for $G_{22}(z)$ and $G_{12}(z)$). For the time-domain response of ipsilateral and contralateral HRTFs, the HRTFs in the time-domain are relatively long in duration as shown at 400. For FIG. 4, the response between 0-100 samples may provide an indication of the location of the sound source (e.g., the speakers 106 and 108) relative to the user. Referring to FIG. 5, the HRTFs include relatively large temporal variations that manifest as jaggedness as shown at 500. When the HRTFs are inverted, the resulting crosstalk cancellation filters may be relatively long in duration. The relatively long duration of the crosstalk cancellation filters may increase computational loads during real-time processing, and contribute to audible artifacts due to direct-inversion of narrow and deep spectral dips (e.g., as observed in the magnitude response of FIG. 5).

Figure 5:
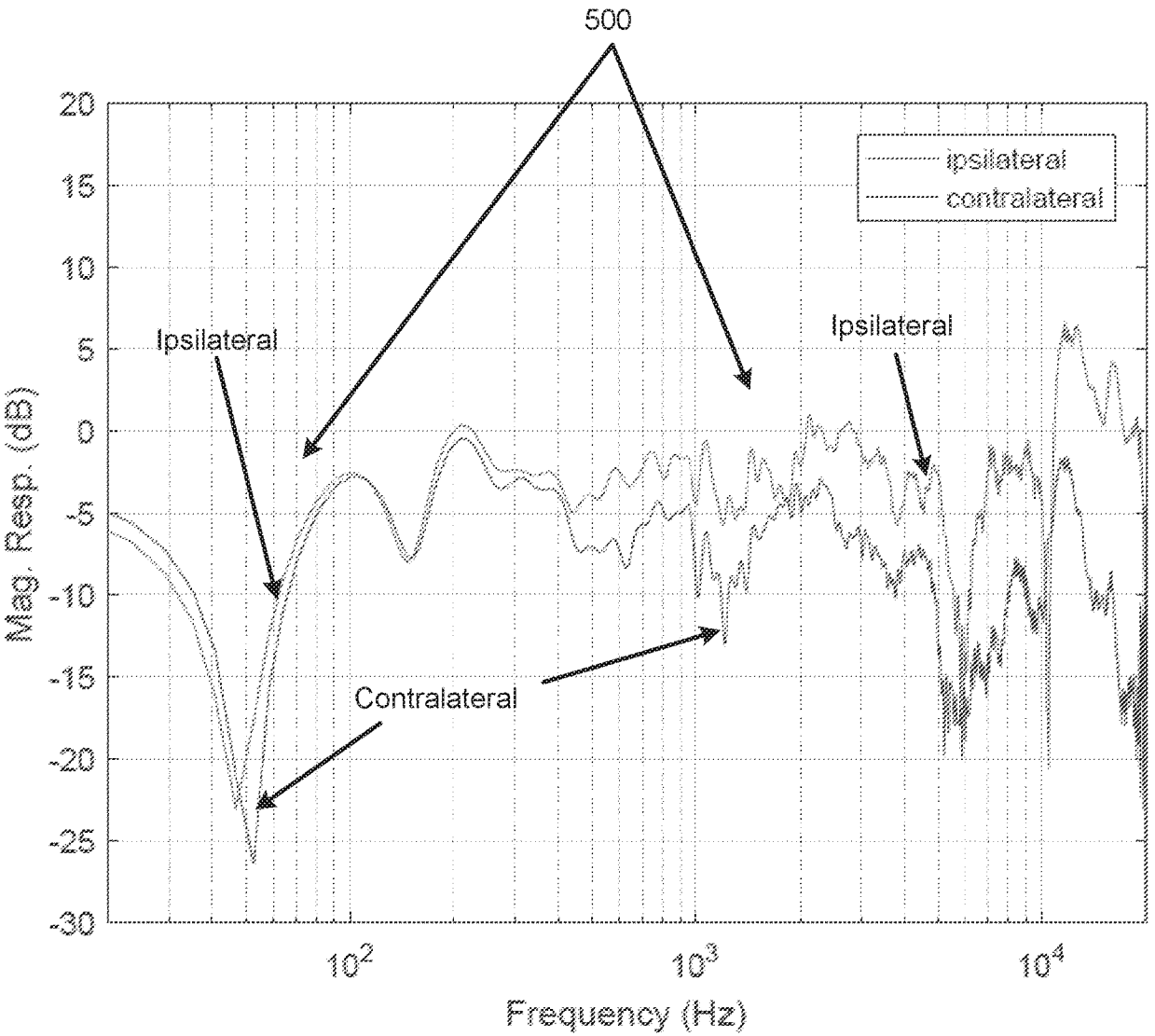
FIG. 5 illustrates an example magnitude response of the time-domain response of ipsilateral and contralateral HRTFs of FIG. 4.

Referring to FIGS. 3-5, in order to address the aforementioned aspects of the relatively long duration of the crosstalk cancellation filters, the perceptual smoothing module 102 is to perceptually smooth the HRTFs corresponding to ipsilateral and contralateral transfer paths of sound emitted from the first and second speakers 106 and 108 to corresponding first and second destinations (e.g., ear-1 and ear-2). The perceptual smoothing module 102 may implement phase and magnitude smoothing, or complex-smoothing, of the time-domain responses to perceptually smooth the HRTFs.

With respect to phase and magnitude smoothing, the perceptual smoothing module 102 may include processing such as critical-band smoothing, equivalent rectangular band smoothing (ERB), or time-domain fractional octave smoothing that perceptually smooths the temporal response.

With respect to complex-smoothing, the perceptual smoothing module 102 may introduce minimum-phase smoothing, thereby eliminating the time-of arrival information.

The perceptual smoothing of the HRTFs may degrade the cues associated with time-of-arrival differences between the two-ears. In this regard, the time difference insertion module 114 is to re-insert the inter-aural time difference 116 in the perceptually smoothed HRTFs corresponding to the contralateral transfer paths. For example, the time difference insertion module 114 is to re-insert the inter-aural time difference 116 by applying the following Equation (1):

$$ITD(\theta) = \frac{a}{c}(\theta + \sin(\theta)) \qquad \text{Equation (1)}$$

For Equation (1), a=0.0875 m may represent the head-radii, Θ may represent the angle of the speaker (e.g., the speaker 106 or 108) from a median plane (viz., 15° in this case), and c=343 m/s may represent the speed of sound. In this regard, the re-insertion of the inter-aural time difference 116 may insert a time delay in the contralateral signal of FIG. 3 so that the ipsilateral and the contralateral signals of FIG. 3 include correct inter-aural cues.

Figure 6:
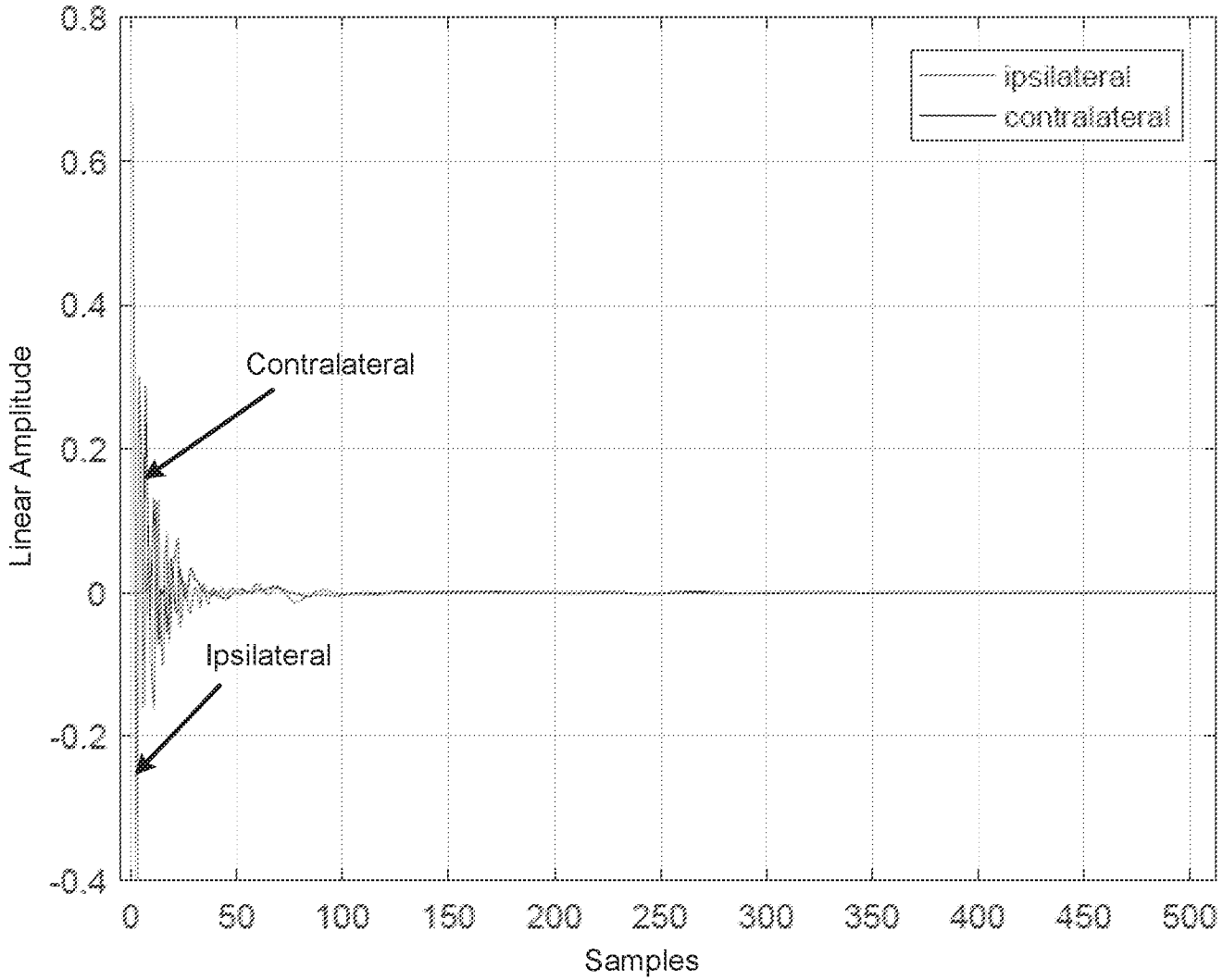
FIG. 6 illustrates an example of complex-smoothed time-domain responses with re-insertion of an inter-aural time difference.

FIG. 6 illustrates an example of complex-smoothed time-domain responses with re-insertion of the inter-aural time difference 116. Further, FIG. 7 illustrates an example magnitude response of the complex-smoothed time-domain responses of FIG. 6.

Figure 7:
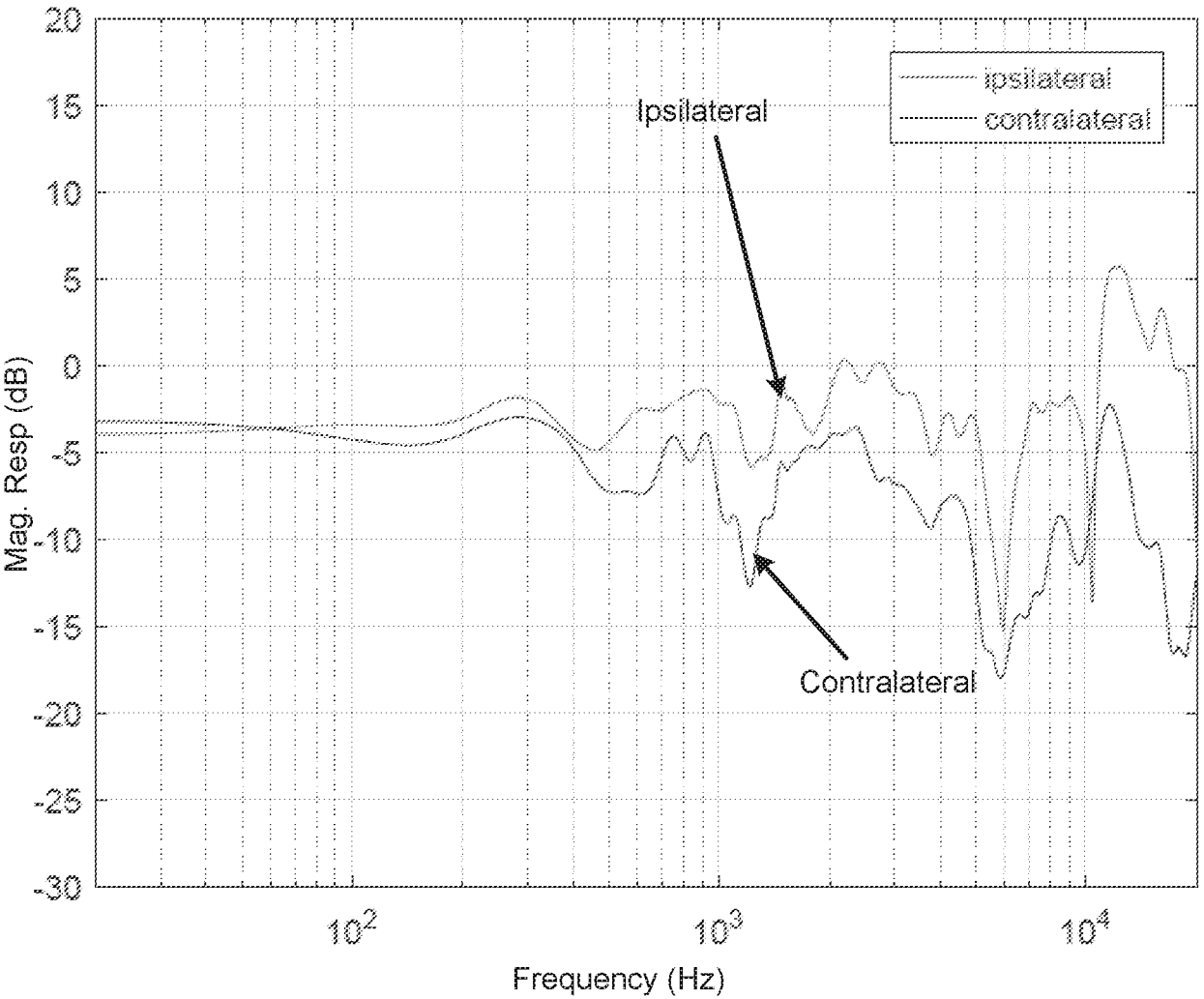
FIG. 7 illustrates an example magnitude response of the complex-smoothed time-domain responses of FIG. 6.

Referring to FIGS. 6 and 7, these figures show the result from using ⅙-th octave complex-domain smoothing that is perceived to be spatially reasonably accurate to the original HRTFs from FIG. 5. The results of FIGS. 6 and 7 may also be perceived as being neutral in quality (e.g., timbre-wise), as ascertained on flat diffuse-field equalized headphones. Further, the results of FIGS. 6 and 7 show a reduction in the duration of the responses. For example, FIG. 6 shows a response duration of approximately 50 samples compared to a response duration of approximately 100 samples for FIG. 4.

With respect to FIGS. 6 and 7, the order of the smoothing may be increased. However, an increase in the order of the smoothing may result in a decrease in localization accuracy.

After smoothing by the perceptual smoothing module 102 as described above, the crosstalk canceller generation module 118 may invert the perceptually smoothed HRTFs corresponding to the ipsilateral transfer paths and the perceptually smoothed HRTFs corresponding to the contralateral transfer paths including the inserted inter-aural time difference 116. In this regard, the crosstalk canceller generation module 118 may generate the crosstalk canceller 120 by determining a Toeplitz convolution matrix that emulates the following matrix Equations (2) to (4):

$$G(z) = \begin{pmatrix} G_{11}(z) & G_{12}(z) \\ G_{21}(z) & G_{22}(z) \end{pmatrix} \quad \text{Equation (2)}$$

$$H(z) = \begin{pmatrix} H_{11}(z) & H_{12}(z) \\ H_{21}(z) & H_{22}(z) \end{pmatrix} \quad \text{Equation (3)}$$

$$H(z)G(z) = z^{-d}I \qquad H(z) = z^{-d}G^{-1}(z) \quad \text{Equation (4)}$$

For Equations (2) to (4), G(z) may represent the ipsilateral and contralateral transfer functions, H(z) may represent the crosstalk canceller filter transfer function to be designed, d may represent the desired delay in samples, I may represent the identity matrix, and z=e^{jw}, where w may represent the angular frequency in radians and w=2*pi*f*T, where f may represent frequency in Hz, T may represent the sampling period, and pi=3.14. With respect to Equations (2) to (4), equalization may be achieved based on the correction of dips and peaks for the ipsilateral ears while minimizing contralateral contribution from DC-20 kHz by using the matrix inverse $G^{-1}(z)$.

The crosstalk canceller generation module 118 may perform frequency-domain or time-domain inversion of the perceptually smoothed HRTFs corresponding to the ipsilateral transfer paths and the perceptually smoothed HRTFs corresponding to the contralateral transfer paths including the inserted inter-aural time difference.

With respect to frequency-domain inversion, the crosstalk canceller generation module 118 may determine the crosstalk filter (e.g., the crosstalk canceller 120) by direct inversion in the frequency domain of Equation (4) using the perceptually smoothed responses.

With respect to time-domain inversion with regularization, $\underline{g}_{ij}=(g_{ij,0} \ldots g_{ij,L_g-1})^t$ may represent the time-domain impulse response of $G_{ij}(z)$, and is a vector of length $L_g$, and $\underline{h}_{ij}=(h_{ij,0}, \ldots, h_{ij,L_h-1})^t$ may represent the time-domain impulse response of $H_{ij}(z)$, and is a vector of length $L_h$. Rewriting in a time-domain form, $$GH=U \quad \text{Equation (5)}$$

For Equation (5), $$G = \begin{pmatrix} \tilde{G}_{11} & \tilde{G}_{12} \\ \tilde{G}_{21} & \tilde{G}_{22} \end{pmatrix} \quad \text{Equation (6)}$$

$$H = \begin{pmatrix} h_{11} & h_{12} \\ h_{21} & h_{22} \end{pmatrix} \quad \text{Equation (7)}$$

$$U = \begin{pmatrix} u_d & 0 \\ 0 & u_d \end{pmatrix} \quad \text{Equation (8)}$$

For Equations (6) to (9), G may represent a time-domain matrix that includes $\tilde{G}_{ij}$ for $\tilde{G}_{11}$, $\tilde{G}_{12}$, $\tilde{G}_{21}$, and $\tilde{G}_{22}$, H may represent time-domain crosstalk canceler filters, and U may represent the identity matrix with appropriate time delays represented along the diagonal for causal filters. In this regard, $\tilde{G}_{ij}$ may represent a convolution matrix in Toeplitz form. The $\tilde{G}_{ij}$ matrix may be expressed as follows:

$$\tilde{G}_{ij} = \begin{pmatrix} g_{ij,0} & \cdots & g_{ij,L_g-1} & 0 & \cdots & 0 \\ 0 & g_{ij,0} & \cdots & g_{ij,L_g-1} & \cdots & 0 \\ \cdots & \cdots & \cdots & \cdots & \cdots & \cdots \\ 0 & \cdots & 0 & g_{ij,0} & \cdots & g_{ij,L_g-1} \end{pmatrix}^t \quad \text{Equation (9)}$$

With respect to Equation (9), the superscript t may denote matrix transpose, with $\tilde{G}_{ij}$ being a real matrix of size $L_h$ $L_g-1 \times L_h$ ($L_h$ being the duration of the desired crosstalk cancellation filter, and $L_g$ being the duration in samples of the perceptually smoothed acoustical path response). The convolution matrix $\tilde{G}_{ij}$ may include the samples $g_{ij,0}$ to $g_{ij,L_{g-1}}$. For the ipsilateral response, the response may be imbedded in the convolution matrix, $\tilde{G}_{ij}$, for example, from sample 0 to sample 500 for the example of FIGS. 4-7. For the convolution matrix $\tilde{G}_{ij}$, $g_{ij,0}$ may represent the ipsilateral response from sample 0 to sample 500 (thus $L_g$=501). Furthermore, $u^d=(0, 0, \ldots, 1, 0, \ldots, 0)^t$ is a vector of size $L_h$ $L_g-1 \times 1$ that represents the equalization. The crosstalk canceller generation module 118 may select the vector to be a high-pass filter with a cut-off frequency equal to the −3 dB low-frequency limit of the speaker response for the speakers 106 and 108. For example, a desktop computer may include a −3 dB point at approximately 250 Hz, whereas mobile telephones, notebooks, and other such devices may include a low-frequency limit that is higher by about an octave.

With respect to the crosstalk canceller generation module 118, given that the matrix G is non-square, a least-squares solution may involve determination of the pseudo-inverse of G as follows:

$$H_{opt} = G^+U = (G^tG + \beta I)^{-1}G^t \quad \text{Equation (10)}$$

For Equation (10), $H_{opt}$ may represent an optimal matrix for implementing the crosstalk canceller 120, and β may represent a regularization term to control the inversion. According to an example, β may be determined via listening assessments to include a tradeoff between objective cancellation performance and timbre (e.g., audio quality). In this regard, γ may be determined by evaluating the condition number of the square matrix $G^tG$ (which is the ratio of the maximum to minimum singular values, derived from the singular value decomposition of the square matrix) with and without β, assessing the crosstalk cancellation performance, and listening evaluations on headphones with pink noise, music, and speech. For the examples of FIGS. 4-7, the value of β may be determined based on convergence as five. In this regard, the crosstalk canceller generation module 118 may determine the regularization term β to control the inversion of the time-domain matrix by comparing a condition number associated with a transpose of the time-domain matrix to a threshold (e.g., 100), and in response to a determination that the condition number is below the threshold, invert the time-domain matrix based on the regularization term to generate the regularized matrix. For example, in the case where β=0, for the example of FIGS. 4-7, the condition number of $G^tG$ is approximately 1.2574e+04 (e.g., greater than the threshold of 100). In the case when β=5 the condition number of $G^tG$ is approximately 32.324 (e.g., less than the threshold of 100), which indicates that the overall matrix is well-conditioned for inversion.

Figure 8:
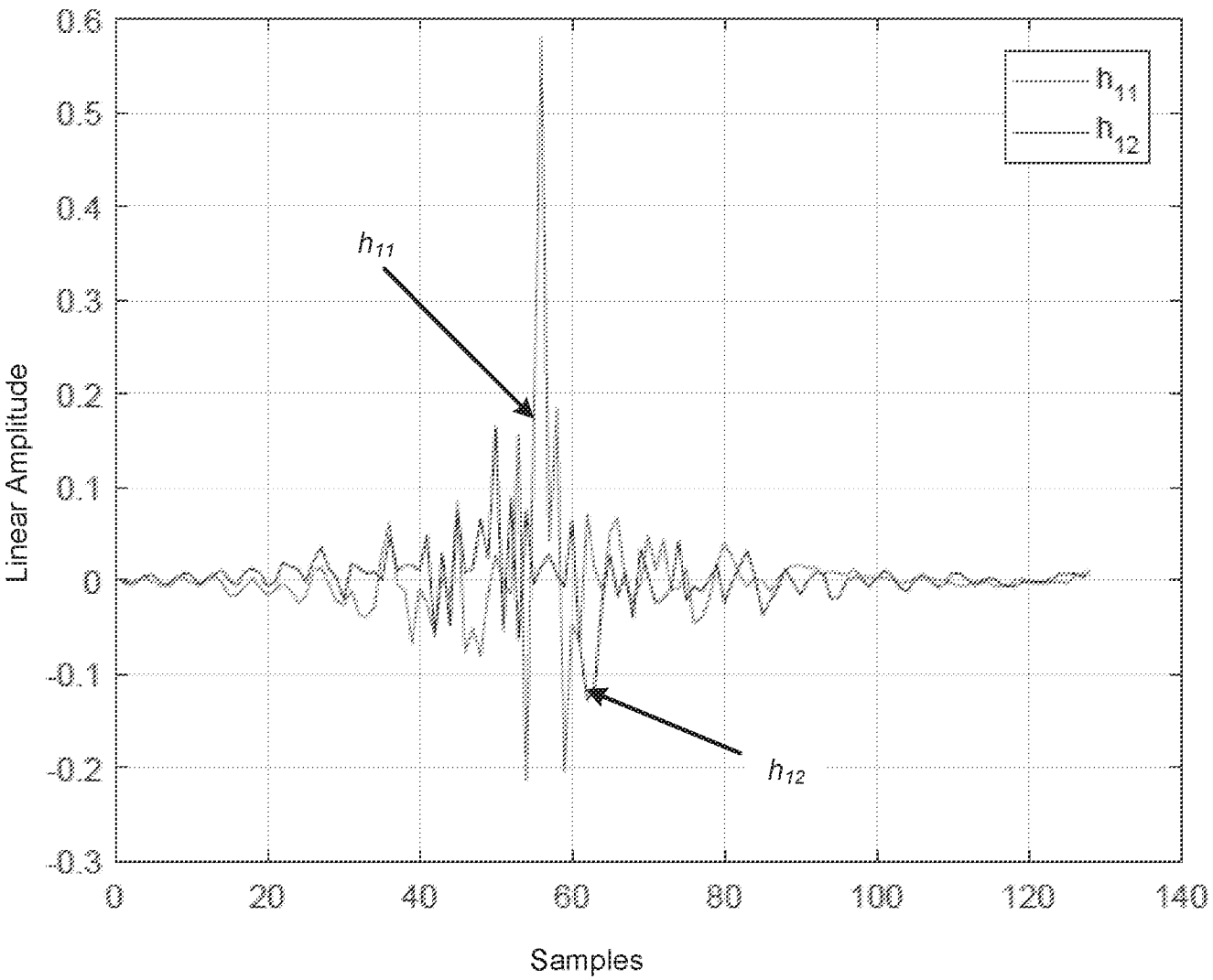
FIG. 8 illustrates an example of time-domain crosstalk cancellation filters including a duration of 128 samples.

FIG. 8 illustrates an example of time-domain crosstalk cancellation filters including a duration of 128 samples. Further, FIG. 9 illustrates an example of a magnitude response of the crosstalk-canceller and the binaural acoustic transfer function of FIG. 3, illustrating equalization and cancellation performance with the filters from FIG. 8.

Figure 9:
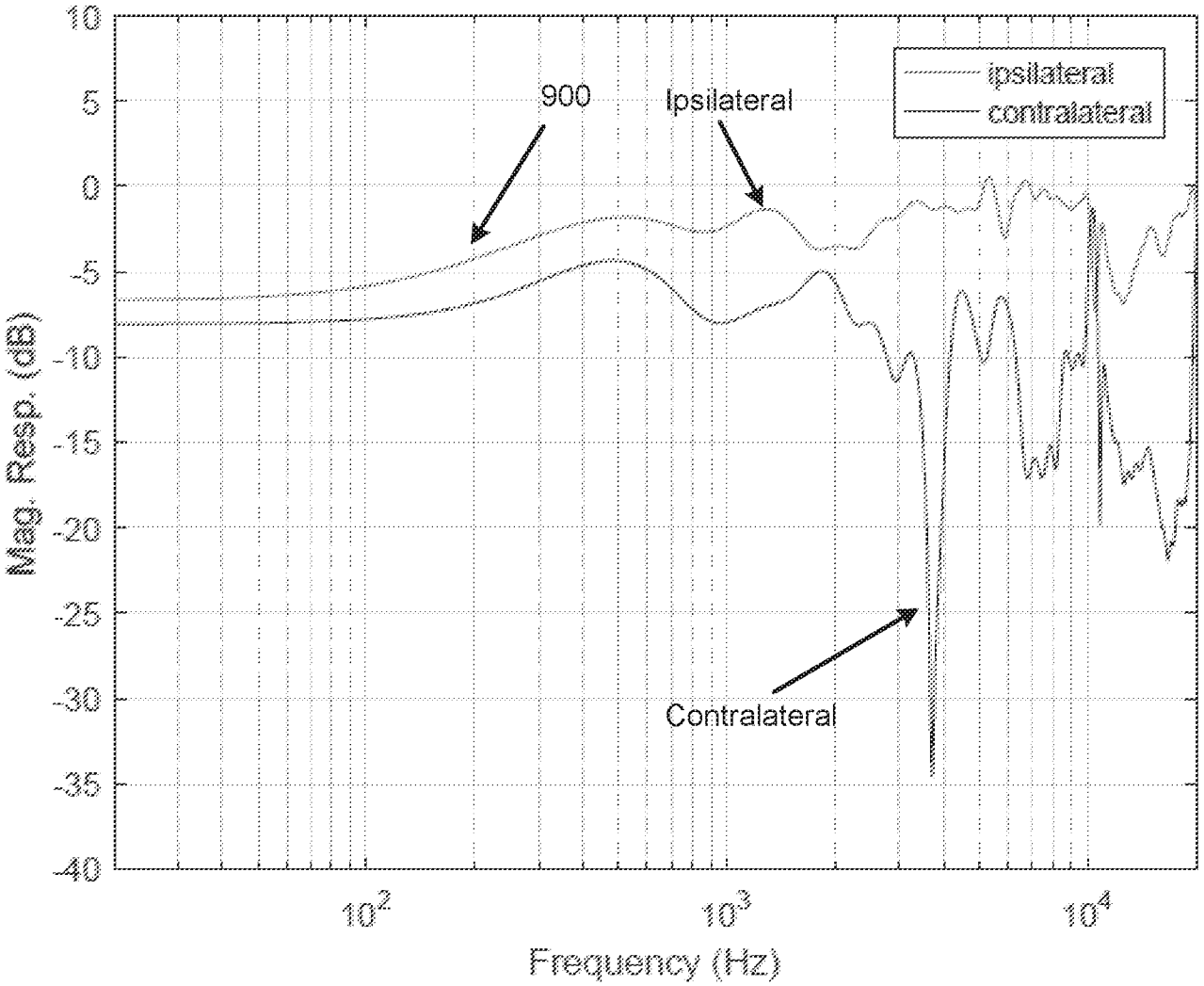
FIG. 9 illustrates an example of a magnitude response of the crosstalk-canceller and the binaural acoustic transfer function of FIG. 3, illustrating equalization and cancellation performance with the filters from FIG. 8.

Referring to FIGS. 8 and 9, and particularly FIG. 9, compared to FIG. 7, equalization performance for ipsilateral response is confirmed, whereas the contralateral response is attenuated by at least approximately 5-10 dB above 200 Hz as shown at 900 (with −3 dB at 200 Hz high-pass filter being programmed in the target response as an example).

Figure 10:
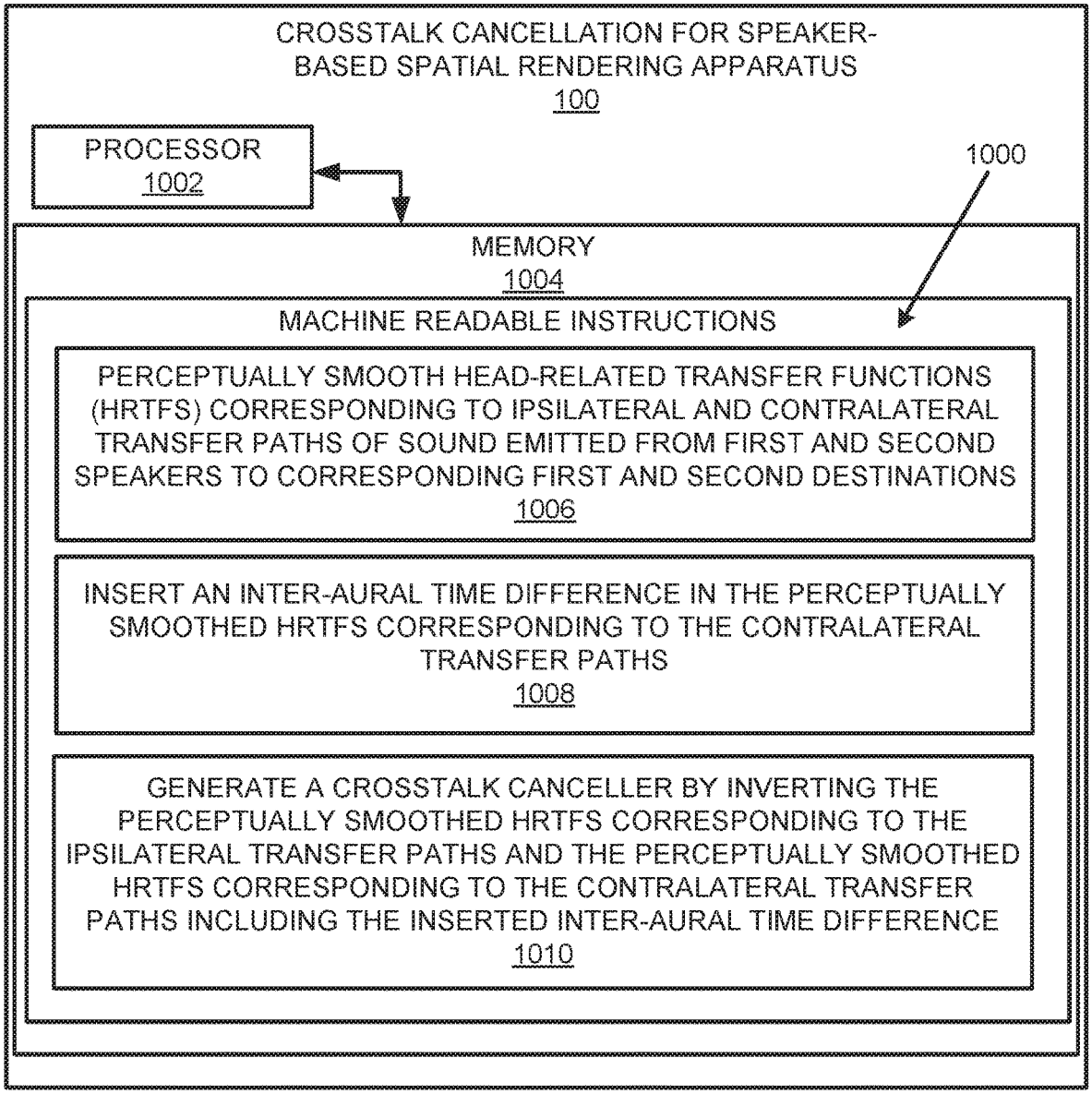
FIG. 10 illustrates an example block diagram for crosstalk cancellation for speaker-based spatial rendering.
Figure 11:
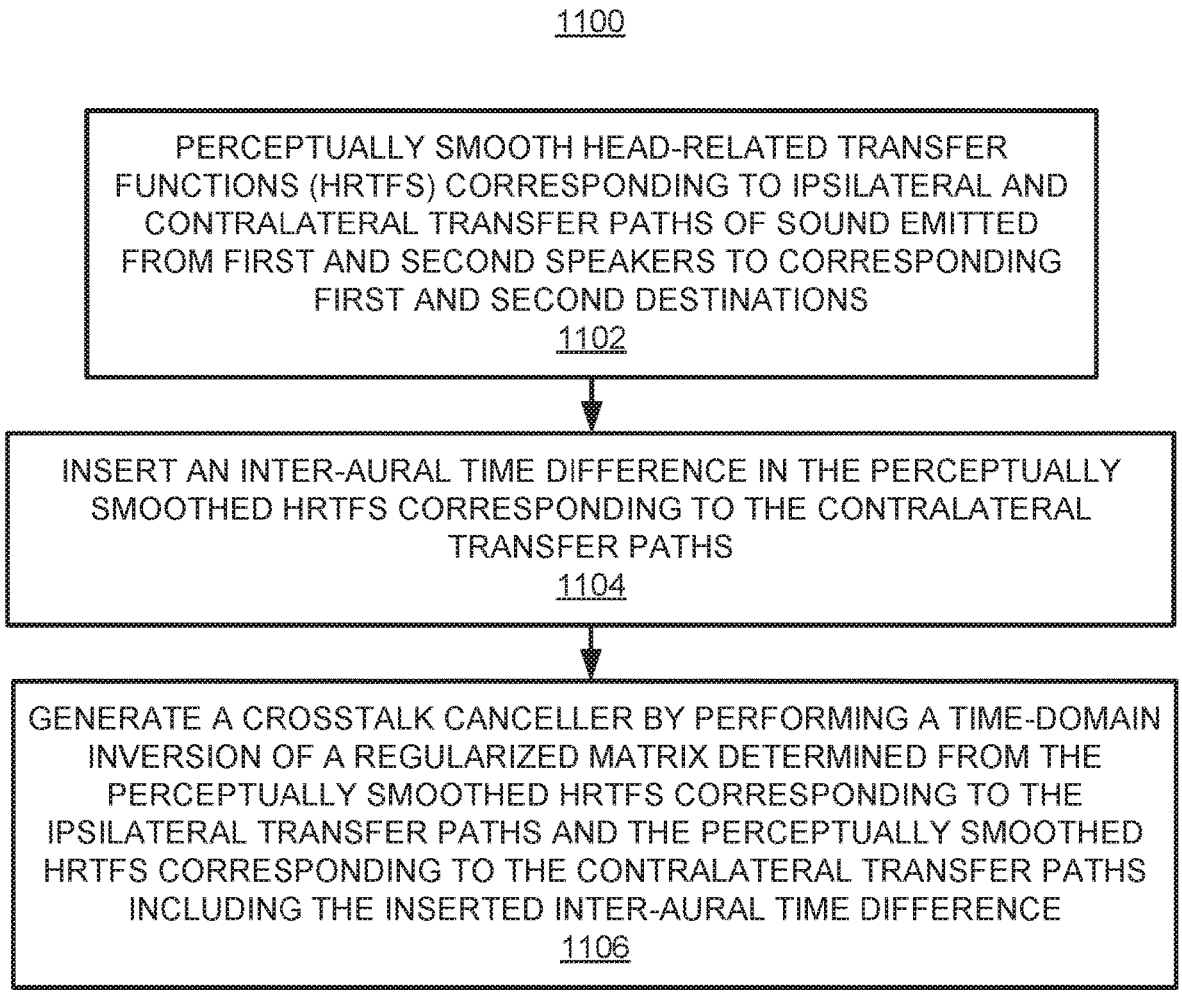
FIG. 11 illustrates an example flowchart of a method for crosstalk cancellation for speaker-based spatial rendering.
Figure 12:
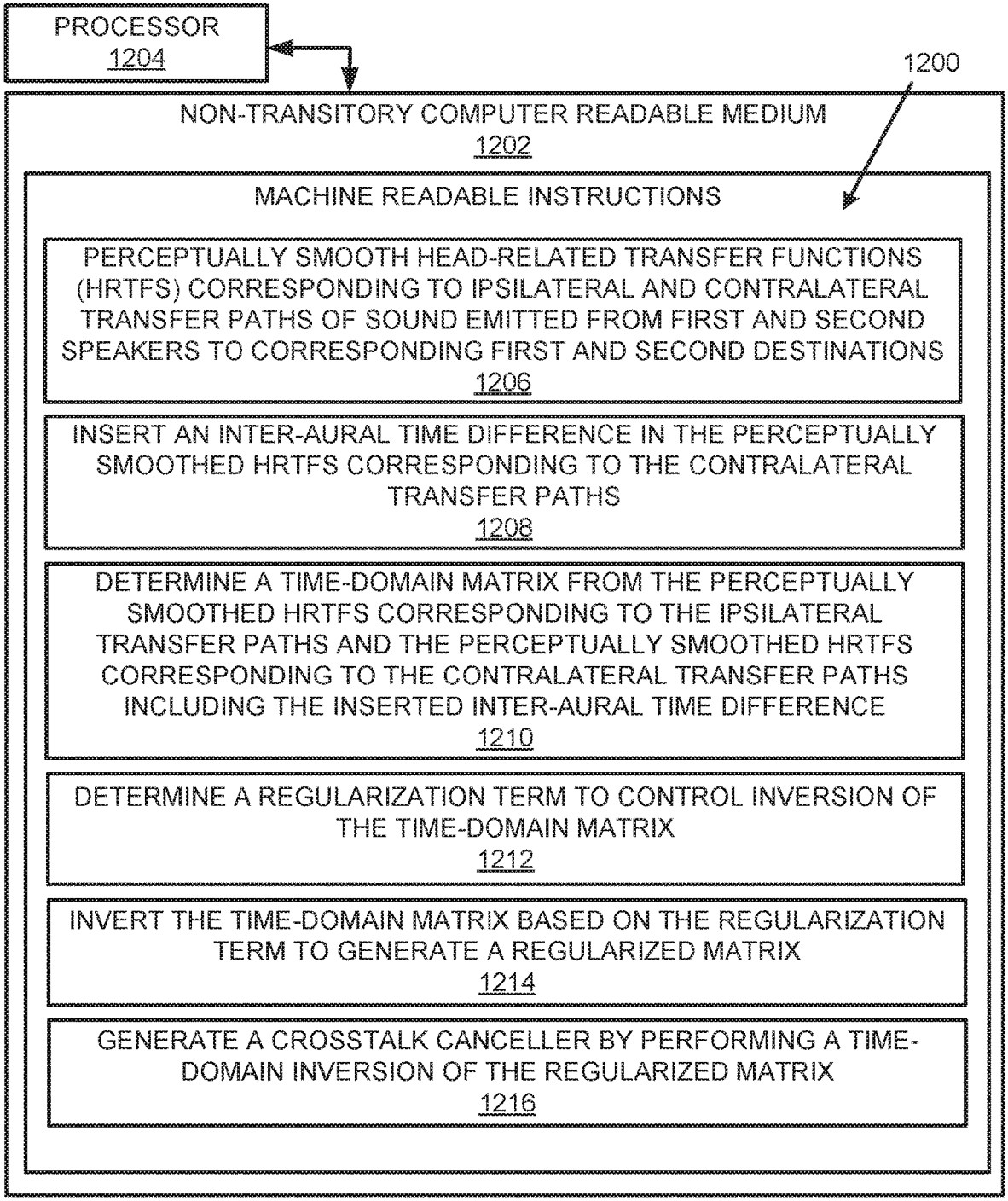
FIG. 12 illustrates a further example block diagram for crosstalk cancellation for speaker-based spatial rendering.

FIGS. 10-12 respectively illustrate an example block diagram 1000, an example flowchart of a method 1100, and a further example block diagram 1200 for crosstalk cancellation for speaker-based spatial rendering. The block diagram 1000, the method 1100, and the block diagram 1200 may be implemented on the apparatus 100 described above with reference to FIG. 1 by way of example and not limitation. The block diagram 1000, the method 1100, and the block diagram 1200 may be practiced in other apparatus. In addition to showing the block diagram 1000, FIG. 10 shows hardware of the apparatus 100 that may execute the instructions of the block diagram 1000. The hardware may include a processor 1002, and a memory 1004 (i.e., a non-transitory computer readable medium) storing machine readable instructions that when executed by the processor cause the processor to perform the instructions of the block diagram 1000. The memory 1004 may represent a non-transitory computer readable medium. FIG. 11 may represent a method for crosstalk cancellation for speaker-based spatial rendering, and the steps of the method. FIG. 12 may represent a non-transitory computer readable medium 1202 having stored thereon machine readable instructions to provide crosstalk cancellation for speaker-based spatial rendering. The machine readable instructions, when executed, cause a processor 1204 to perform the instructions of the block diagram 1200 also shown in FIG. 12.

The processor 1002 of FIG. 10 and/or the processor 1204 of FIG. 12 may include a single or multiple processors or other hardware processing circuit, to execute the methods, functions and other processes described herein. These methods, functions and other processes may be embodied as machine readable instructions stored on a computer readable medium, which may be non-transitory (e.g., the non-transitory computer readable medium 1202 of FIG. 12), such as hardware storage devices (e.g., RAM (random access memory), ROM (read only memory), EPROM (erasable, programmable ROM), EEPROM (electrically erasable, programmable ROM), hard drives, and flash memory). The memory 1004 may include a RAM, where the machine readable instructions and data for a processor may reside during runtime.

Referring to FIGS. 1-10, and particularly to the block diagram 1000 shown in FIG. 10, the memory 1004 may include instructions 1006 to perceptually smooth (e.g., by the perceptual smoothing module 102) HRTFs 104 corresponding to ipsilateral and contralateral transfer paths of sound emitted from first and second speakers (e.g., the speakers 106 and 108) to corresponding first and second destinations (e.g., the destinations 110 and 112).

The processor 1002 may fetch, decode, and execute the instructions 1008 to insert (e.g., by the time difference insertion module 114) an inter-aural time difference 116 in the perceptually smoothed HRTFs corresponding to the contralateral transfer paths.

The processor 1002 may fetch, decode, and execute the instructions 1010 to generate (e.g., by the crosstalk canceller generation module 118) a crosstalk canceller 120 by inverting the perceptually smoothed HRTFs corresponding to the ipsilateral transfer paths and the perceptually smoothed HRTFs corresponding to the contralateral transfer paths including the inserted inter-aural time difference 116.

Referring to FIGS. 1-9 and 11, and particularly FIG. 11, for the method 1100, at block 1102, the method may include perceptually smoothing (e.g., by the perceptual smoothing module 102) HRTFs 104 corresponding to ipsilateral and contralateral transfer paths of sound emitted from first and second speakers (e.g., the speakers 106 and 108) to corresponding first and second destinations (e.g., the destinations 110 and 112).

At block 1104, the method may include inserting an inter-aural time difference (e.g., by the time difference insertion module 114) in the perceptually smoothed HRTFs corresponding to the contralateral transfer paths.

At block 1106, the method may include generating (e.g., by the crosstalk canceller generation module 118) a crosstalk canceller 120 by performing a time-domain inversion of a regularized matrix determined from the perceptually smoothed HRTFs corresponding to the ipsilateral transfer paths and the perceptually smoothed HRTFs corresponding to the contralateral transfer paths including the inserted inter-aural time difference 116.

Referring to FIGS. 1-9 and 12, and particularly FIG. 12, for the block diagram 1200, the non-transitory computer readable medium 1202 may include instructions 1206 to perceptually smooth (e.g., by the perceptual smoothing module 102) HRTFs 104 corresponding to ipsilateral and contralateral transfer paths of sound emitted from first and second speakers (e.g., the speakers 106 and 108) to corresponding first and second destinations (e.g., the destinations 110 and 112).

The processor 1204 may fetch, decode, and execute the instructions 1208 to insert (e.g., by the time difference insertion module 114) an inter-aural time difference 116 in the perceptually smoothed HRTFs corresponding to the contralateral transfer paths.

The processor 1204 may fetch, decode, and execute the instructions 1210 to determine (e.g., by the crosstalk canceller generation module 118) a time-domain matrix from the perceptually smoothed HRTFs corresponding to the ipsilateral transfer paths and the perceptually smoothed HRTFs corresponding to the contralateral transfer paths including the inserted inter-aural time difference 116.

The processor 1204 may fetch, decode, and execute the instructions 1212 to determine (e.g., by the crosstalk canceller generation module 118) a regularization term (e.g., $\beta$) to control inversion of the time-domain matrix.

The processor 1204 may fetch, decode, and execute the instructions 1214 to invert (e.g., by the crosstalk canceller generation module 118) the time-domain matrix based on the regularization term to generate a regularized matrix.

The processor 1204 may fetch, decode, and execute the instructions 1216 to generate (e.g., by the crosstalk canceller generation module 118) a crosstalk canceller 120 by performing a time-domain inversion of the regularized matrix.

What has been described and illustrated herein is an example along with some of its variations. The terms, descriptions and figures used herein are set forth by way of illustration only and are not meant as limitations. Many variations are possible within the spirit and scope of the subject matter, which is intended to be defined by the following claims—and their equivalents—in which all terms are meant in their broadest reasonable sense unless otherwise indicated.

What is claimed is:

1. An apparatus comprising:

a processor; and a non-transitory computer readable medium storing machine readable instructions that when executed by the processor cause the processor to:

perceptually smooth head-related transfer functions (HRTFs) corresponding to ipsilateral and contralateral transfer paths of sound emitted from first and second speakers to corresponding first and second destinations;

insert an inter-aural time difference in the perceptually smoothed HRTFs corresponding to the contralateral transfer paths; and generate a crosstalk canceller by inverting the perceptually smoothed HRTFs corresponding to the ipsilateral transfer paths and the perceptually smoothed HRTFs corresponding to the contralateral transfer paths including the inserted inter-aural time difference.

2. The apparatus according to claim 1, wherein the perceptual smoothing includes phase and magnitude smoothing, or complex smoothing of the HRTFs.

3. The apparatus according to claim 1, wherein the first and second destinations correspond to first and second ears of a user, and the inter-aural time difference is determined as a function of a head radius of the user, and an angle of one of the speakers from a median plane of a device that includes the speakers.

4. The apparatus according to claim 1, wherein the instructions are further to cause the processor to:

determine a regularized matrix from the perceptually smoothed HRTFs corresponding to the ipsilateral transfer paths and the perceptually smoothed HRTFs corresponding to the contralateral transfer paths including the inserted inter-aural time difference; and generate the crosstalk canceller by performing a time-domain inversion of the determined regularized matrix.

5. The apparatus according to claim 4, wherein the instructions are further to cause the processor to:

determine a time-domain matrix from the perceptually smoothed HRTFs corresponding to the ipsilateral transfer paths and the perceptually smoothed HRTFs corresponding to the contralateral transfer paths including the inserted inter-aural time difference, determine a regularization term to control inversion of the time-domain matrix, and invert the time-domain matrix based on the regularization term to generate the regularized matrix.

6. The apparatus according to claim 5, wherein the instructions are further to cause the processor to:

determine the regularization term to control the inversion of the time-domain matrix by comparing a condition number associated with a transpose of the time-domain matrix to a threshold; and in response to a determination that the condition number is below the threshold, invert the time-domain matrix based on the regularization term to generate the regularized matrix.

7. The apparatus according to claim 4, wherein the instructions are further to cause the processor to:

validate a condition number of the regularized matrix prior to the performing of the time-domain inversion of the regularized matrix.

8. The apparatus according to claim 1, wherein the instructions are further to cause the processor to:

attenuate a contralateral response of the first and second speakers based on application of the crosstalk canceller to signals received by the first and second speakers.

9. A method comprising:

perceptually smoothing, by a processor, head-related transfer functions (HRTFs) corresponding to ipsilateral and contralateral transfer paths of sound emitted from first and second speakers to corresponding first and second destinations;

inserting an inter-aural time difference in the perceptually smoothed HRTFs corresponding to the contralateral transfer paths;

determining a regularized matrix determined from the perceptually smoothed HRTFs corresponding to the ipsilateral transfer paths and the perceptually smoothed HRTFs corresponding to the contralateral transfer paths including the inserted inter-aural time difference; and generating a crosstalk canceller by performing a time-domain inversion of the determined regularized matrix.

10. The method according to claim 9, wherein the first and second destinations correspond to first and second ears of a user, further comprising:

determining the inter-aural time difference as a function of a head radius of the user, and an angle of one of the speakers from a median plane of a device that includes the speakers.

11. The method according to claim 9, further comprising:

validating a condition number of the regularized matrix prior to the performing of the time-domain inversion of the regularized matrix.

12. The method according to claim 9, further comprising:

attenuating a contralateral response of the first and second speakers based on application of the crosstalk canceller to signals received by the first and second speakers.

13. A non-transitory computer readable medium having stored thereon machine readable instructions, the machine readable instructions, when executed, cause a processor to:

perceptually smooth head-related transfer functions (HRTFs) corresponding to ipsilateral and contralateral transfer paths of sound emitted from first and second speakers to corresponding first and second destinations;

insert an inter-aural time difference in the perceptually smoothed HRTFs corresponding to the contralateral transfer paths;

determine a time-domain matrix from the perceptually smoothed HRTFs corresponding to the ipsilateral transfer paths and the perceptually smoothed HRTFs corresponding to the contralateral transfer paths including the inserted inter-aural time difference;

determine a regularization term to control inversion of the time-domain matrix;

invert the time-domain matrix based on the regularization term to generate a regularized matrix; and generate a crosstalk canceller by performing a time-domain inversion of the regularized matrix.

14. The non-transitory computer readable medium according to claim 13, wherein the instructions are further to cause the processor to:

determine the regularization term to control the inversion of the time-domain matrix by comparing a condition number associated with a transpose of the time-domain matrix to a threshold; and in response to a determination that the condition number is below the threshold, invert the time-domain matrix based on the regularization term to generate the regularized matrix.

15. The non-transitory computer readable medium according to claim 13, wherein the instructions are further to cause the processor to:

attenuate a contralateral response of the first and second speakers based on application of the crosstalk canceller to signals received by the first and second speakers.

* * * * *